US005941456A

United States Patent [19]

Waryu et al.

[11] Patent Number: 5,941,456

[45] Date of Patent: Aug. 24, 1999

[54] NOZZLE CLEANING SYSTEM INCLUDING COATING SPRAY GUN COVER FOR CAN COATING SYSTEM

[75] Inventors: Joseph C. Waryu, Amherst; Thomas A. Loparo, Elyria; Sean Scott Davis, Lorain, all of Ohio

[73] Assignee: Nordson Corporation, Westlake, Ohio

[21] Appl. No.: 09/015,171

[22] Filed: Jan. 29, 1998

Related U.S. Application Data

[63] Continuation of application No. 08/877,079, Jun. 17, 1997, abandoned.

[51] Int. Cl.[6] ..... B05B 1/25; B05B 15/02

[52] U.S. Cl. ..... 239/112; 239/288; 239/570

[58] Field of Search ..... 239/112, 543, 239/570, 104, 170, 121, 288–288.5

[56] References Cited

U.S. PATENT DOCUMENTS

| | | | |
|---|---|---|---|
| 1,147,933 | 7/1915 | Ford . | |
| 1,610,714 | 12/1926 | Smith . | |
| 1,988,979 | 1/1935 | Campbell . | |
| 2,161,131 | 6/1939 | Burger . | |
| 3,211,377 | 10/1965 | Brenner . | |
| 3,275,240 | 9/1966 | Peaslee et al. | 239/570 |
| 3,711,028 | 1/1973 | Hengesbach . | |
| 3,726,711 | 4/1973 | Hogstrom . | |
| 3,859,113 | 1/1975 | Horvath et al. . | |
| 3,876,144 | 4/1975 | Madden et al. . | |
| 4,378,386 | 3/1983 | Rehman . | |
| 4,767,056 | 8/1988 | Demetrius et al. . | |
| 4,814,794 | 3/1989 | Sato . | |
| 4,886,013 | 12/1989 | Turner et al. . | |
| 4,951,875 | 8/1990 | Devey . | |
| 5,078,325 | 1/1992 | Waryu et al. . | |
| 5,405,087 | 4/1995 | Waryu et al. . | |

FOREIGN PATENT DOCUMENTS

| | | | |
|---|---|---|---|
| 0221622 | 5/1987 | European Pat. Off. . | |
| 0446120 | 9/1991 | European Pat. Off. . | |
| 2366880 | 5/1978 | France . | |
| 57-209668 | 12/1982 | Japan . | |
| 62-42668 | 12/1982 | Japan . | |
| 58-074165 | 5/1983 | Japan . | |
| 62-042668 | 9/1989 | Japan . | |
| 6-142571 | 5/1994 | Japan | 239/112 |
| 390742 | 8/1965 | Switzerland . | |
| 2079184 | 1/1982 | United Kingdom . | |

*Primary Examiner*—Kevin Weldon
*Attorney, Agent, or Firm*—Calfee, Halter & Griswold LLP

[57] ABSTRACT

An apparatus for cleaning a coating gun nozzle used in spraying the inner surface of cans with a coating material comprises a cleaning solution spray nozzle having a cleaning spray extension and a cleaning spray nozzle for spraying a cleaning solution onto the coating gun nozzle to remove oversprayed coating material collecting thereon. The coating gun nozzle is disposed at an end of a coating gun nozzle extension. A single spray shield is disposed over the end of the coating gun nozzle extension, and has a flange portion which extends at least to an external surface of the cleaning nozzle extension to shield the components of the apparatus from oversprayed coating material. A check valve mechanism disposed within the cleaning spray extension prevents cleaning solution from dribbling or drooling from the cleaning spray nozzle. A control system controls the operation of the apparatus.

20 Claims, 5 Drawing Sheets

NOZZLE CLEANING SYSTEM INCLUDING COATING SPRAY GUN COVER FOR CAN COATING SYSTEM

RELATED APPLICATIONS

This application is a continuation of U.S. application Ser. No. 08/877,079 now abandoned, entitled NOZZLE CLEANING SYSTEM INCLUDING COATING SPRAY GUN COVER FOR CAN COATING SYSTEM, and having a filing date of Jun. 17, 1997 and a common assignee with the present application.

FIELD OF THE INVENTION

The invention relates to method and apparatus for spraying a coating onto a substrate, such as a lacquer coating onto an inner surface of a can, while protecting components of the system from overspray and, more particularly, to cleaning the coating spray nozzle of the coating spray gun used in the spray coating process.

BACKGROUND OF THE INVENTION

In a conventional spray coating process for spray coating surfaces, such as the inner surface of cans, small particles of sprayed coating material adhere to the surface being sprayed and form a coating film. Some of the fine particles of coating material, however, do not adhere to the surface being coated and form a mist (called "overspray" herein) which floats in the vicinity of the spray apparatus. Some of the overspray sticks to the spray or coating gun and to its spray nozzle, and gradually accumulates to form a layer of coating material thereon. Sometimes, globs of the accumulated material fall into the spray and become a part of the coating on the surface being sprayed. These globs of coating material mar the appearance of the coated surface and can also cause a defect in the can when the globs do not cure in the allotted time.

Another problem caused by oversprayed coating material collecting on the spray nozzle is the partial blockage of the spray nozzle orifice and a resulting distortion in the spray pattern causing a portion of the sprayed surface to be left substantially uncoated.

To avoid these problems associated with oversprayed coating material, machine operators must periodically stop the coating process and clean the spray nozzle. In addition to having to periodically clean the nozzle, it is common for the operators to periodically coat the exposed surfaces of the spray gun, with the exception of the spray nozzle, with grease or animal fat to enable the gun to be more easily cleaned of overspray with a rag. Also, in some cases, cardboard spray shields have been placed on the spray gun body to prevent some of the overspray from accumulating on the spray gun. However, these spray shields are not only crude, but become soggy and quickly loose their effectiveness. Moreover, these cardboard shields do not protect the nozzle and the portion of the gun barrel or extension closest to the nozzle which is of particular importance.

In a prior art system for cleaning spray nozzles, as disclosed in Japanese Document No. 62-42688 assigned to Nordson Corporation, there is described a method and apparatus for cleaning spray nozzles wherein a hood is installed at the base of the spray coating nozzle. However, this hood is spaced from the spray nozzle and does not prevent overspray from accumulating on the spray nozzle itself or on the portion of the gun barrel or extension closest to the nozzle. This prior art document also shows a solvent spray nozzle positioned above or alongside the spray coating nozzle to spray a solvent on the spray coating nozzle immediately after a specified number of coating operations are completed to rinse off oversprayed coating material. However, when fewer than the specified number of coating operations are completed, typically at the end of a production run, the solvent is not sprayed onto the spray nozzle and the coating material can dry or skin over on the nozzle and clog it.

Another prior art spray gun system, having means for cleaning a coating spray nozzle, of a spray gun system is described hereinbelow.

SUMMARY OF THE INVENTION

It is an object of the present invention to provide method and apparatus for cleaning a spray gun and spray nozzle, the method and apparatus being as defined in one or more of the appended claims and, as such, having the capability of being constructed to accomplish one or more of the following subsidiary objects.

It is a further object of the present invention to provide method and apparatus for cleaning a spray gun and preventing oversprayed coating material from collecting on the spray gun and on an associated nozzle cleaning gun.

It is a still further object of the present invention to provide an method and apparatus for cleaning a coating spray gun wherein disposable, plastic sleeves are placed on the coating spray gun to prevent build up of the overspray coating material on the coating spray gun as well as a cleaning spray gun of the system.

It is a yet further object of the present invention to provide method and apparatus for avoiding residual cleaning solution (e.g., water) from dripping off of the cleaning spray nozzle onto the surface being coated.

In accordance with the invention, a spray gun system includes a coating spray gun having a coating spray extension and a first(coating)spray nozzle disposed at an end of the coating spray extension, a cleaning solution spray nozzle having a cleaning spray extension and a second(cleaning) spray nozzle disposed at an end of the cleaning spray extension, a solenoid-operated supply valve capable of alternately permitting or prohibiting a flow of cleaning solution from a supply of pressurized cleaning solution to the cleaning solution spray nozzle, and a controller coordinating the operation of the spray components. A fluid line which may be flexible, rigid or a stainless steel tube is connected between the supply valve and the cleaning spray extension. A check valve mechanism is disposed within the cleaning spray extension. A bracket secures the coating spray extension and cleaning spray extension in a desired position and orientation with respect to one another. A spray shield has a tubular portion sized to fit snugly over the coating spray gun extension and a radial flange portion which extends substantially to an external surface of the cleaning spray extension or at least partially around the external surface of the cleaning spray extension. The spray shield prevents overspray from accumulating on the spray gun system components.

In accordance with the invention, the cleaning spray extension has an inlet end opening extending into an inlet end of the cleaning spray extension, a fluid passageway extending longitudinally within the cleaning spray extension from the inlet end opening partially towards an outlet end opening of the cleaning spray extension element, to a longitudinal cylindrical chamber within the cleaning spray extension. The longitudinal cylindrical chamber has an inlet end adjacent an outlet end of the fluid passageway and an outlet end which is the outlet end opening of the cleaning spray extension. The inlet end of the longitudinal cylindrical chamber is tapered to function as a valve seat, against which a ball is urged by a spring. This forms a check valve mechanism which permits fluid to flow from the fluid passageway to the longitudinal cylindrical chamber only when fluid pressure in the fluid passageway exceeds a closing force exerted by the spring on the ball, thereby preventing cleaning solution from accumulating and dripping or drooling off of the cleaning spray nozzle.

In accordance with the invention, the cleaning spray extension is positioned and oriented with respect to the coating spray gun extension by a bracket having a lower portion, a middle portion and an upper portion. The lower portion of the bracket has a bore sized to fit around an exterior surface of the coating spray gun extension, and the upper portion of the bracket has a bore sized to fit around an exterior surface of the cleaning spray extension. Set screws extend through threaded holes in the lower and upper portions of the bracket to securely position and orient the coating spray gun extension and cleaning spray extension, respectively.

In accordance with the invention, a controller coordinates the operation of the coating and cleaning components for spray coating the interior surfaces of cans which are conveyed past the coating gun. The controller has multiple modes of operation.

DETAILED DESCRIPTION OF THE DRAWINGS

The structure, operation, and advantages of the present preferred embodiment of the invention will become further apparent upon consideration of the following description taken in conjunction with the accompanying drawings, wherein.

DETAILED DESCRIPTION OF THE INVENTION

The present invention of a spray system advantageously employs a number of individual elements of prior art spray systems, an exemplary one of which is described immediately hereinbelow. Commonly-owned U.S. Pat. No. 5,344,073 entitled NOZZLE CLEANING SYSTEM INCLUDING SPRAY GUN COVER FOR CAN COATING SYSTEM discloses an apparatus for cleaning a coating gun nozzle used in spraying the inner surface of cans with a coating material. A cleaning gun has an extension terminating in a cleaning nozzle and is positioned by an articulated bracket to one end of a coating gun extension for spraying cleaning solution onto the coating gun nozzle. Cover sleeves are provided on both the cleaning gun and coating gun extensions to shield the cleaning and coating guns from oversprayed coating material. A control system controls the operation of the coating and cleaning guns.

Figure 1:
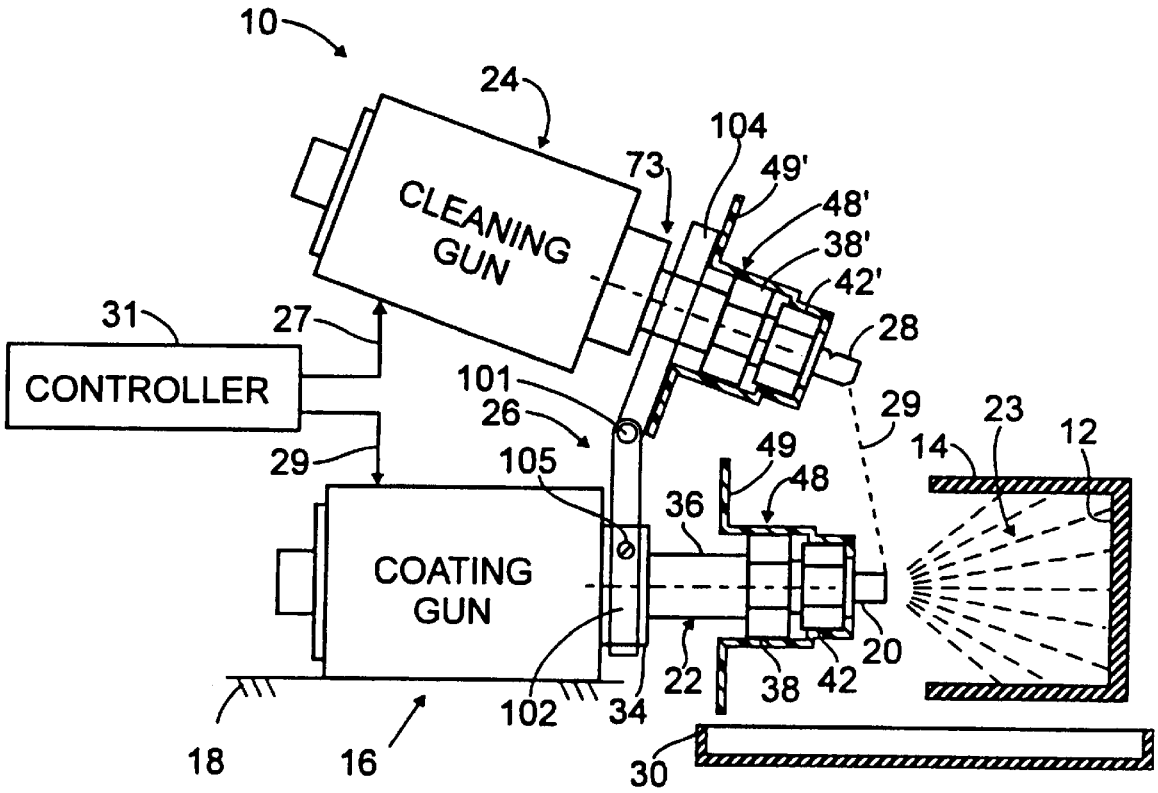
Fig.1 Prior Art
FIG. 1 is a side, partially schematic view of a spray gun system for coating a can interior including a nozzle cleaning gun adjustably secured to a coating gun for spraying a cleaning solution onto the nozzle of the coating gun, according to the prior art.

FIG. 1 illustrates an exemplary prior art spray gun system 10 of the type described in the aforementioned U.S. Pat. No. 5,344,073 which is hereby incorporated by reference in its entirety. The spray gun system 10 is utilized for spray coating a surface, such as the inside bottom surface 12 of a can 14 with a spray or coating gun 16. The spray gun 16 could be of any known design, including that which is shown in U.S. Pat. No. 5,078,325 which is hereby incorporated by reference in its entirety. The cans are positioned in front of the spray gun and rotated as required by a drive apparatus (not shown), such as the apparatus in J62-42688. The spray gun system 10 includes a spray or coating gun 16 mounted to a support base 18. Spray gun 16 includes a spray nozzle 20 mounted to one end of a spray gun extension 22 for directing a spray coating material 23 into the can 14.

A nozzle cleaning gun 24 is adjustably mounted adjacent to coating gun 16 by a mounting bracket 26. The cleaning spray gun 24 has a cleaning spray nozzle 28 mounted at one end for spraying a liquid cleaning solution 29, such as water or solvent, onto the spray nozzle 20 of the spray gun 16 to keep the spray nozzle clean of oversprayed coating material. A collection trough 30 is positioned below the spray nozzle 20 to collect the cleaning solution and the washed-off coating material from the spray nozzle. A timing control system 31 is connected by lines 27 and 29, preferably electrical, to the coating gun 16 and the cleaning gun 24, respectively, for cycling them on and off.

The spray coating gun 16 has an inlet port (not shown) connected to a supply of coating material by any conventional means, such as a hose. The coating gun 16 can be cycled on and off by any desired means, such as the timing control system 31 at any predetermined time. For example, the spray gun can be cycled on whenever a can is positioned in front of the spray nozzle 20.

The coating gun 16 includes a spray nozzle extension 22 terminating in a spray nozzle 20. For purposes of this discussion, the spray nozzle extension 22 also has a retaining nut 38 (such as, but not limited, to a hexagonal nut), and the spray nozzle 20 is secured to the outlet end 40 in sealing relation thereto by a nozzle nut 42 (such as, but not limited to, a hexagonal nut).

The spray coating gun 16 and spray nozzle 20 are protected from overspray by a cover sleeve 48 which has a tubular main body portion that fits snugly and removably over the nozzle nut 42. A front end of the cover sleeve 48 is provided with an opening through which the nozzle 20 extends. A rearward end of the cover sleeve 48 extends radially outwardly as an annular flange 49 having an outer dimension (diameter) which is preferably at least as great as the diameter of the can 14.

The cover sleeve 48 has a generally uniform wall thickness of about 0.020 to about 0.040 inches. More preferably, the wall thickness is about 0.027 to about 0.033 inches. The wall thickness is sufficient to provide a sturdy sleeve that can withstand the rigors associated with the spraying of coatings during the manufacture of cans, it is thin enough so that the cover sleeve is inexpensive and disposable. Preferably, the cover sleeve 48 is made of a material selected from the group comprising polyethylene and polypropylene.

More particularly, the cover sleeve 48 includes a tubular body portion which has an elongated, annular inlet portion having an internal diameter which is slightly larger than the dimension across opposite edges of the retaining nut 38 on spray extension 22 to provide a slight clearance therebetween.

In the aforementioned U.S. Pat. No. 5,344,073, the nozzle cleaning spray gun 24 illustrated in FIG. 1, could be of any conventional design suitable for spraying a liquid cleaning solution 29 onto the spray nozzle 20 to wash off and prevent any accumulation of oversprayed coating material thereon. If the coating material 23 is water based, the cleaning solution 29 can be water. If the coating material is solvent based, the cleaning solution will be an appropriate solvent.

The cleaning gun 24 has an inlet port (not shown) connected to a supply of liquid cleaning solution (not shown) by any conventional means, such as a hose. The cleaning spray gun 24 includes a spray nozzle extension 73 which is comparable to the spray nozzle extension 22 of the coating spray gun 16. Similarly, two nuts 38' and 42' are provided, as is a nozzle 28 (compare 20). Throughout the specification, where elements are substantially identical, prime numbers are used to indicate like elements having unprimed numbers. The cleaning spray gun 24 is provided with a cover sleeve 48' which is comparable in shape, fit and material to the cover sleeve 48 of the coating spray gun 16.

The cleaning spray gun 24 is adjustably mounted adjacent to the spray gun 16 by means of a mounting bracket 26. The bracket 26 includes a mounting arm 102 which is adjustably secured about the first portion 34 of the spray extension 22. For example, the mounting arm 102 can have a cylindrical bore extending therethrough which enables the arm to be rotated about the cylindrically shaped portion 34 to any desired position. Moreover, the mounting arm 102 can be moved in a longitudinal direction towards or away from the middle portion 36 of the spray extension 22. Securing means 105, such as set screws, affix the arm 102 to the portion 34 in the desired location and orientation. The bracket 26 also includes a cleaning gun mounting arm 104 which is pivotally secured at one end to mounting arm 102 by any desired means such as a bolt 101. The mounting arm 104 can include a substantially semicircular, upwardly facing surface upon which the middle portion 76 of the nozzle extension 73 is supported. A strap 106, having a semicircular, inwardly facing surface can be placed about the portion 76 and secured to the mounting arm 104 by means such as bolt 109 to locate the cleaning gun 24 in a desired position and orientation with respect to the coating gun 16.

In this manner, the cleaning spray gun 24 can be positioned above or along side the spray gun 16 by adjusting the bracket 26. Proper positioning enables the liquid cleaning solution 29 being sprayed from cleaning spray nozzle 28 to be directed against the spray nozzle 20 of the coating gun 16. The cleaning solution washes the spray nozzle 20 and keeps it clean of any oversprayed coating material.

The spray coating system 10 includes a collection trough 30 positioned below the spray nozzle 20 to collect the cleaning solution 29 and any of the coating material 23 which is washed away during the spraying of the spray nozzle 20 with cleaning solution 29 from the cleaning nozzle 28. The collection trough 30 is positioned on the opposite side of the coating spray gun 16 with respect to the nozzle cleaning gun 24 so all of the liquid rinsed off of the nozzle 20 will be collected therein.

An exemplary nozzle cleaning system controller (timing control system) 31 is described in detail with respect to FIG. 6 of the aforementioned U.S. Pat. No. 5,344,073. Generally, the controller 31 coordinates the operation of the coating spray gun 16, the cleaning spray gun 24, and a mechanism (not shown) for presenting cans to be coated (sprayed). For example, the number of cans that have been sprayed is counted by the controller 31, and an operator can select a cleaning spray cycle to occur after every can or up to every fifteenth can or more. When cleaning the coating spray nozzle 20, it is important to ensure that no can will be subjected to the cleaning spray. For example, the controller 31 can incorporate a delay, for example of 1–15 milliseconds or more preferably 5 to about 15 milliseconds, after initiating a cleaning cycle prior to activating the cleaning spray gun 24. This time delay allows the coating spray to completely stop before the cleaning spray begins. After initiating cleaning, the cleaning spray gun 24 is operated for a predetermined interval of time, for example, for about 1 to about 255 milliseconds or more preferably about 5 to 35 milliseconds and yet more preferably about 10 to 15 milliseconds. In this manner, oversprayed coating material collecting on the tip of the nozzle 20 is continually washed off and the nozzle 20 is kept clean. This avoids any adverse effects from the coating material accumulating on the nozzle. In addition to automatically controlling washing the coating nozzle 20 periodically, a second way to initiate the cleaning cycle is by providing a manual "override" function in the controller 31. In addition to the automatic and manual initiations of the wash cycle, a "watchdog" timing mechanism can be provided to ensure that the cleaning cycle is initiated if there are no clean sprays within a third predetermined period of time, such as about 5 seconds. This is particularly important at the end of a manufacturing cycle when less than the preset number of cans have been coated. The watchdog mode of initiating a cleaning cycle thereby prevents any coating material on the spray nozzle 20 from drying and interfering with the spray pattern during the next cycle of operation. The watch dog timer is reset every time the coating gun cycles on. Appropriate logic and latches are provided to ensure that the cleaning spray gun 24 does not activate while a can is being coated.

There has thus been described a complete spray gun system of the prior art. As is evident, the system 10 requires two shields 48 and 48' to prevent overspray from accumulating on the coating and cleaning guns, there is a noticeable gap between the two shields 48 and 48', the cleaning spray gun 24 is somewhat bulky, and the articulated linkage 26 permits a user to inadvertently misalign the cleaning spray gun 24 and the coating spray gun 16 and/or allows the cleaning spray gun 24 to become misaligned as a result of mechanical stresses associated with normal operation of spray gun system.

IMPROVED SPRAY GUN SYSTEM

Figure 2:
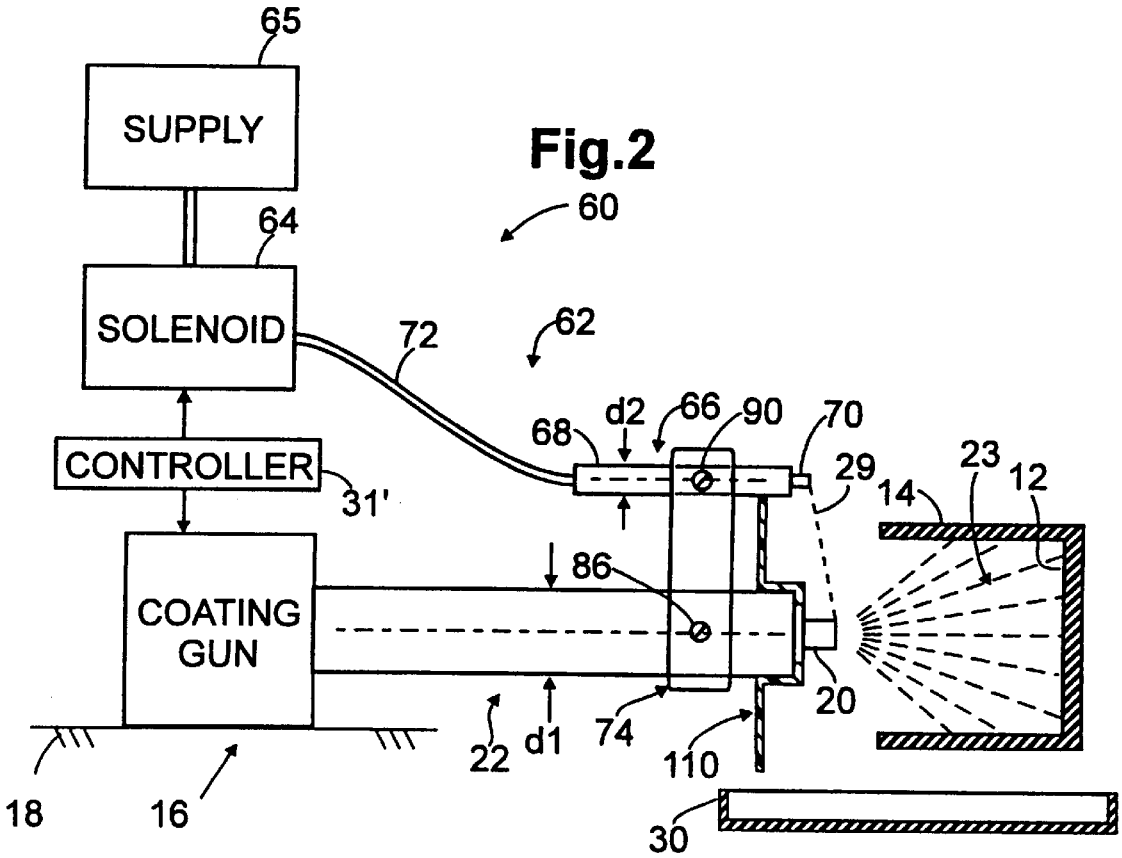
FIG. 2 is a side, partially schematic view of a spray gun system for coating a can interior including a nozzle cleaning gun adjustably secured to a coating gun for spraying a cleaning solution onto the nozzle of the coating gun, according to an embodiment of the invention.

Referring to FIG. 2, a novel spray gun system 60 is illustrated which can advantageously employ the coating gun 16 illustrated in FIG. 1, or any comparable coating gun suitable for spraying a spray coating material 23 onto a surface, such as the inside bottom surface 12 of a can 14. The present invention is directed to a novel design for a cleaning spray system 62 which includes a cleaning spray solenoid 64, a cleaning solution (water) spray nozzle 66 comprising a cleaning spray extension 68 and a cleaning spray nozzle 70, and a flexible line 72 connected between the solenoid 64 and the cleaning spray extension 68 of the water spray nozzle 66. In use, the solenoid 64 is supplied with pressurized cleaning solution which suitably is water from a supply (source) 65.

The spray gun system 60 shares many elements with the previously-described spray gun system 10. More particularly, the spray gun system 60 has a coating spray gun 16, a nozzle extension 22, and a spray nozzle 20 disposed at the end of the nozzle extension 22 for spraying a coating material 23 onto a surface of a substrate such as the inside surface 12 of a can. The spray gun system 60 also includes a controller 31', comparable to the controller 31 or the spray gun system 10, for exercising control over operation of the coating spray gun 16, the solenoid 64 (compare the cleaning spray gun 24), and the indexing of cans 14 into the system for coating. The spray gun system 60 also includes a trough 30 for collecting cleaning solution and coating material washed off the coating spray nozzle 20.

The spray gun system 60 includes a rigid bracket 74 which secures the water spray nozzle 66 in a fixed positional relationship with the coating spray gun extension 22. As illustrated in FIG. 2, the bracket 74 is such that the longitudinal axis of the water spray nozzle 66 is suitably parallel to the longitudinal axis of the coating spray gun nozzle 22.

Figure 3A:
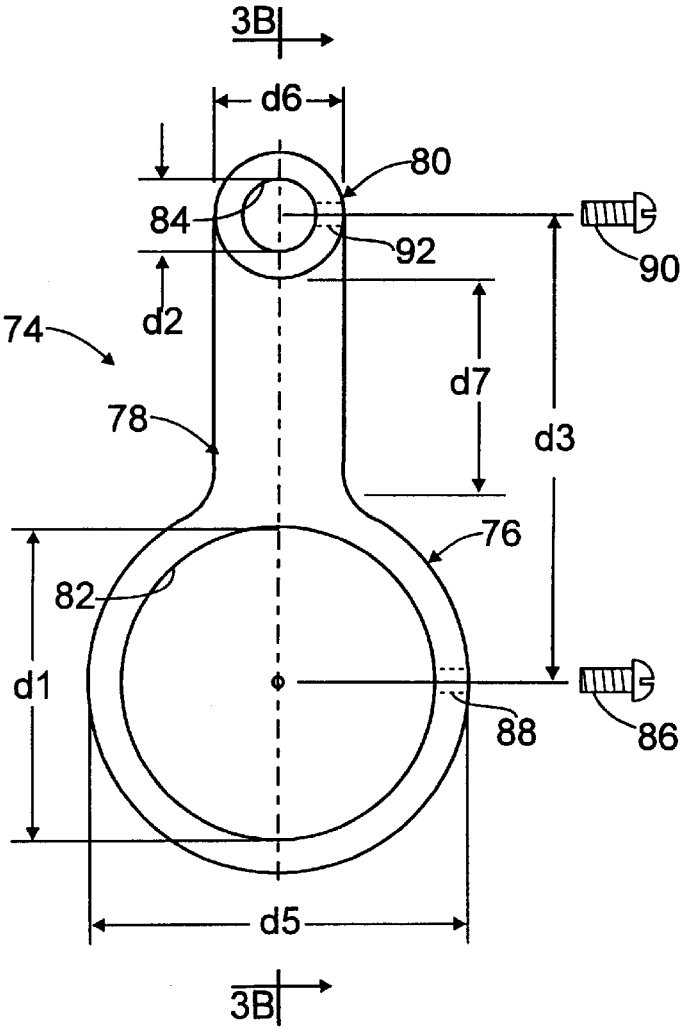
FIG. 3A is a front view of a bracket for the spray gun system of the invention.
Figure 3B:
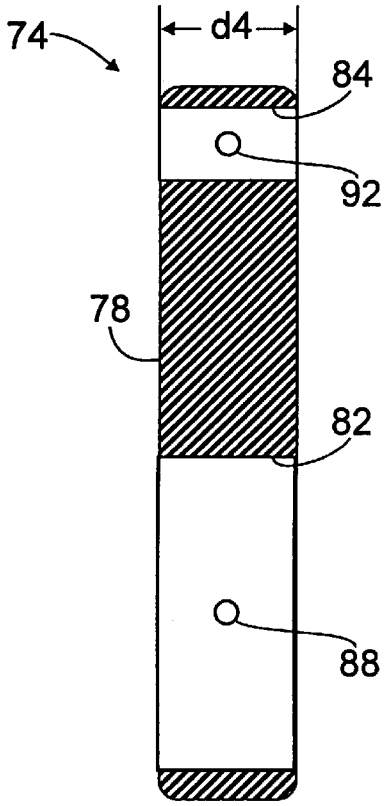
FIG. 3B is a side cross-sectional view of the bracket of FIG. 3A.

The bracket 74 itself is illustrated in FIG. 3A and FIG. 3B. The bracket 74 has a lower portion 76, a middle portion 78 and an upper portion 80. The lower portion 76 is in the form of an annular ring, having a bore 82 with an inside diameter "d1" which permits the lower portion 76 to slip over the barrel extension 22 of the coating spray gun 16. The upper portion 80 is in the form of an annular ring, having a bore 84 with an inside diameter "d2" which permits the upper portion 80 to slip over the cleaning spray extension 68 of the water spray nozzle 66. The center of the upper portion 80 is spaced a distance "d3" from the center of the lower portion 76 to establish an appropriate spacing between the coating spray gun 16 and the water spray nozzle 66. The middle portion 78 connects the upper portion 80 to the lower portion 76, and the entire bracket 74 may be formed as an integral structure, for example by machining a block of stainless steel having a thickness of "d4", the dimension of the bracket 74 which is parallel to the longitudinal axes of the extensions 22 and 66.

The external shape and size of the bracket 74 is less critical than the dimensions and spacing of the bores 82 and 84, and is generally in the shape of an automotive connecting rod. For example, the lower portion 76 is cylindrical having an external surface of diameter "d5" (and a 'height' of "d4"), the upper portion 80 is cylindrical having an external surface of diameter "d6" (and a 'height' of "d4"), and the middle portion 78 is a rectangular solid having a height "d7" equal to "d3" minus one-half of "d5" (the external radius of the lower portion) minus one-half of "d6" (the external radius of the upper portion), and suitably (but not necessarily) having a length of "d6" and a width of "d4". The lower and upper portions 76 and 80, respectively, are suitably radiused where they meet with the middle portion 78. The bracket 74 is suitably machined from a block of stainless steel.

Exemplary suitable dimensions for the bracket are: "d1" is in the range of 1.005–1.010 inches, "d2" is in the range of 0.285–0.290 inches, "d3" is approximately 1.437+/−0.010 inches, "d4" is approximately 0.500+/−0.010 inches, "d5" is approximately 1.250+/−0.010 inches, and "d6" is approximately 0.500+/−0.010 inches.

To assemble the water spray nozzle 66 with the coating spray gun 16, the lower portion 76 of the bracket 74 is slipped over the extension 22 of the coating spray gun 16, whereupon it can be moved longitudinally to any desired position along the extension 22 and can be rotated to any desired orientation. Once it is properly positioned and oriented, the bracket 74 can be locked into place with a set screw 86 inserted through a threaded hold 88 in the lower portion 76. This securely positions and orients the coating spray extension 22 within the lower portion 76 of the bracket 74.

Next, the water spray nozzle 66 can be inserted through the upper portion 80 of the bracket 74, whereupon the water spray nozzle 66 can be moved longitudinally to any desired position and can be rotated to any desired orientation within the bracket 74. Once it is properly positioned and oriented, the water spray nozzle 66 can be locked into place with a set screw 90 inserted through a threaded hole 92 in the upper portion 80. The set screws 86 and 90 are suitably 10–32 machine screws having sufficient length, for example one-half inch, to extend through the bracket from its external surface, into the bores 82 and 84, respectively, and further to press against the external surfaces of the extension 22 and water spray nozzle 66, respectively. The set screws 86 and 90 are torqued sufficiently to prevent any changes in the relative positioning and orientation of the extension 22 and water spray nozzle 66 during operation of the spray gun system 60.

Referring to FIG. 2, since the water spray nozzle 66 is positioned to be parallel to the coating spray gun nozzle extension 22, it is evident that the cleaning spray 29 must exit the water spray nozzle at an angle to the longitudinal axis of the water spray nozzle 66. This angle can be anywhere from 90° (ninety degrees) to the longitudinal axis to, for example, 45° to the longitudinal axis, and is illustrated in FIG. 2 as being at an angle of 20° to the longitudinal axis.

The controller 31' is operable in much the same manner as that of the controller 31 of the spray gun system 10. More particularly, the controller 31' can operate in an automatic mode initiating the cleaning of the coating spray nozzle 20 every 1–10 (for example) cycles of can coating, the controller 31' can operate in a manual mode, and the controller can operate in response to a watchdog timer.

An important aspect of the present invention is that the cleaning spray gun (solenoid) 64 is no longer mounted to the coating spray gun 16. Instead, the cleaning spray gun 64 is mounted away from the coating spray gun 16 and is connected by either a flexible tube or a stainless steel tube 72 to the water spray nozzle 66 which is mounted by the bracket 74 to the coating spray gun 16. Generally, a rigid tube can withstand greater pressure than a flexible tube. For example, for a flexible tube the maximum fluid pressure may be 300 psi, and for a comparable rigid tube the maximum fluid pressure may be 500 psi. This reduces the size and weight of the water and coating spray elements of the spray gun system 60. The solenoid 64 is suitably any conventional solenoid-operated valve capable of alternately permitting (supplying) or prohibiting a flow of cleaning solution from a supply (not shown) of pressurized cleaning solution to the spray nozzle 66.

SPRAY SHIELD

As shown in FIG. 2, the spray gun system 60 of the invention advantageously employs only single spray shield 110.

The spray shield 110 is comparable in many respects to the spray shields 48 and 48' of the prior art spray gun system 10, i.e., in choice of materials and thicknesses. The spray shield 110 differs from the spray shield 48 and 48' of the prior art spray gun system 10 mainly in its dimensions and consequent advantageous functionality.

Figure 4A:
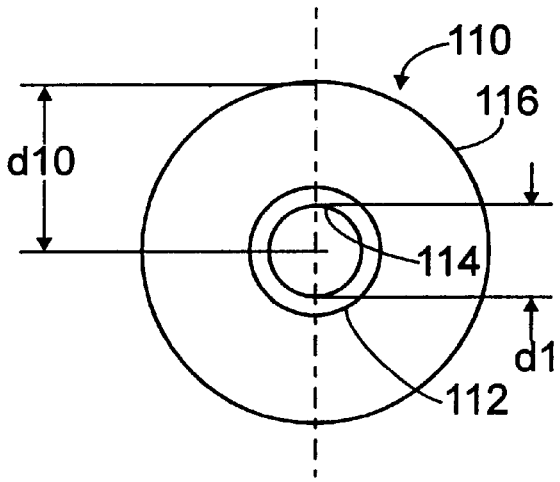
FIG. 4A is a front view of a spray shield for the spray gun system of the invention.
Figure 4B:
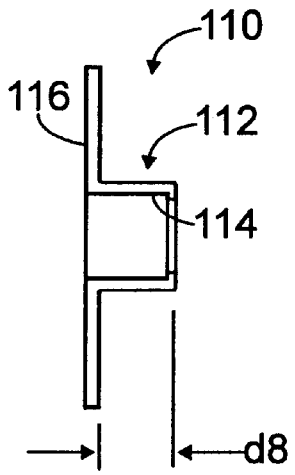
FIG. 4B is a side cross-sectional view of the spray shield of FIG. 4A.

Referring to FIGS. 4A and 4B, the spray shield 110 comprises an elongated tubular body portion 112 having an internal bore 114 adapted to fit snugly (in liquid-tight engagement) over the end of the extension 22 or any nuts (compare 42) which may be disposed thereon, immediately rearward of and closely adjacent to the coating spray nozzle 20. To effect this snug fit, the inside diameter (bore) 114 of the tubular body portion 112 is suitably no greater than the inside diameter "d1" of the bore 82 of the lower portion 76 of the bracket 74. This feature (i.e., the snug fit of the tubular portion 112 over the end of the extension 22) of the spray shield 110 of the present invention is comparable to corresponding features of the spray shields 48 and 48' of the prior art spray gun system 10.

The tubular body portion 112 of the spray shield extends longitudinally along the length of the extension 22 a distance "d8", whereat it merges with a flange portion 116 extending radially outward to shield the rearward portions of the coating spray gun 16 from overspray. The flange portion 116 has a height as measured from the center of the tubular portion 112 of "d10". The dimension "d10" is the radius of the flange portion 116, and is sufficient that the flange portion 116 extends substantially to the external surface of the water spray nozzle 66. It is thus evident that the dimension "d10" is approximately equal to, but no greater than "d3" (the distance between the bores 82 and 84 of the bracket 74) minus one-half of "d2" (the diameter of the water spray nozzle 66). In this manner, great protection against overspray is achieved with a single spray shield 110 which does not suffer from the aforementioned problem of there being a gap between two spray shields (48 and 48').

The spray shield 110 has a generally uniform wall thickness of about 0.020 to about 0.040 inches. More preferably, the wall thickness is about 0.027 to about 0.033 inches. The wall thickness is sufficient to provide a sturdy shield that can withstand the rigors associated with the spraying of coatings during the manufacture of cans, and it is thin enough so that the cover sleeve is inexpensive and disposable. Preferably, the spray shield 110 is made of a material selected from the group comprising polyethylene and polypropylene.

ALTERNATE EMBODIMENT OF SPRAY SHIELD

Figure 4C:
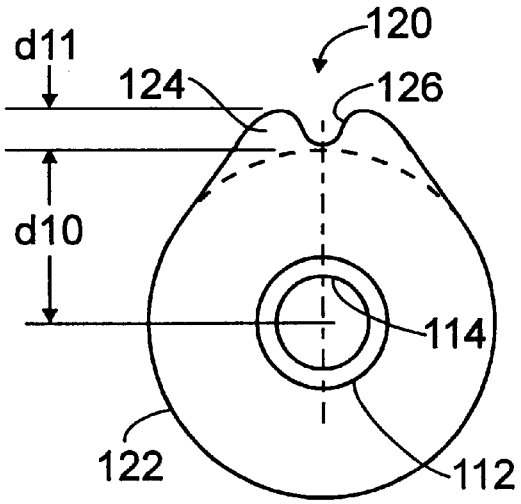
FIG. 4C is a front view of an alternate embodiment of a spray shield for the spray gun system of the invention.

Referring to FIG. 4C, there is shown an alternate embodiment of a spray shield 120. The spray shield 120 is identical with the spray shield 110 except with regard to the size and shape of its flange portion 122. In this embodiment, the flange portion 122 is disc-shaped except at an upper portion 124 thereof where it extends further than (beyond) the external surface of the water spray nozzle 66. More particularly the upper portion 124 extends a distance "d11" which is approximately equal to the diameter "d2" of the water spray nozzle 66 and is provided with a semi-circular cutout 126 so that it comes into contact and wraps (fits) at least partially, such as 180° around the external surface of the water spray nozzle 66. While a semi-circular cutout is illustrated, it is within the terms of the invention to use a cutout with any desired shape to fit around the external surface of the water spray nozzle. In this manner, even greater protection against overspray is achieved.

WATER (CLEANING SOLUTION) SPRAY NOZZLE

A generalized cleaning spray nozzle 66 has been described hereinabove with respect to FIG. 2. A key aspect of the present invention is a novel design of a cleaning spray nozzle itself.

Figure 5:
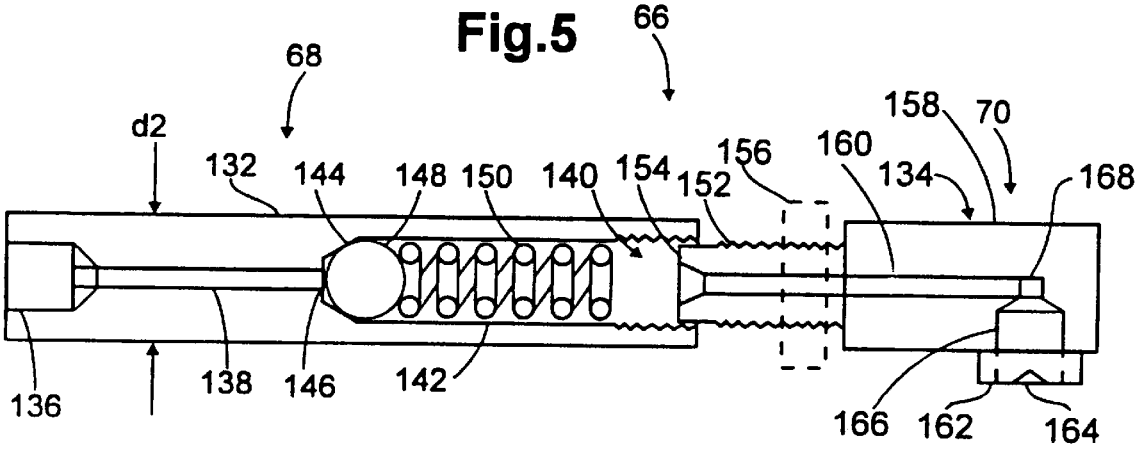
FIG. 5 is side cross-sectional view, partially exploded, of a clean spray extension comprising a cleaning spray nozzle and associated extension of the invention.

Referring to FIG. 5, there is illustrated a preferred embodiment of a water spray nozzle 66 for the spray gun system 60 of the present invention. The water spray nozzle 66 comprises two main components, an extension element 132 (68) and a nozzle element 134 (70). These two elements 132 and 134 are generally cylindrical and coaxial. An opening 136 is provided at an inlet end of the extension element 132, extending into the extension element 132, and is adapted to receive cleaning solution from the solenoid 64 via the pressurized line 72. Suitable fittings (not shown) are provided to ensure a pressure-tight fit between the fluid line 72 and the inlet end of the extension element 132. A fluid passageway 138 extends longitudinally within the extension element 132 from the inlet end opening 136 partially towards an outlet end opening 140 of the extension element 132. The fluid passageway 138 is relatively small in diameter as compared with the outside diameter "d2" of the extension element, for example approximately 0.062+/−0.010 inches in diameter as compared with 0.285–0.290 inches. The fluid passageway 138 extends from the inlet opening 136 to a longitudinal cylindrical chamber 142 within the extension element 132. The chamber 142 has an inlet end 144 adjacent the outlet end 146 of the fluid passageway and an outlet end which is the outlet end opening 140 of the extension element 132. The inlet end 144 of the chamber is tapered to function as a valve seat for a ball 148 which is urged against the valve seat 144 by any suitable means, such as by a conventional coil spring 150. As will be seen, the coil spring 150, ball 148 and valve seat 144 function in the manner of a conventional check valve mechanism. Namely, when fluid pressure in the fluid passageway 138 exceeds the closing force exerted by the spring 150 on the ball 148, the ball 148 is moved away from the valve seat 144 permitting fluid to flow from the fluid passageway 138 into the chamber 142.

The outlet end portion of the extension element 132 is threaded to receive a threaded end portion 152 of the nozzle element 134. More particularly, at least an end portion of the chamber 142 is provided with internal female threads and the end portion 152 of the nozzle element 134 is provided with mating male threads.

The inlet end surface 154 of the nozzle element 134 is sized and shaped to apply a closing force upon the spring 150 when the nozzle element 134 is screwed into the extension element 132. The amount that the nozzle element 134 is screwed into the extension element 132 controls the amount of closing force on the ball 148 against the valve seat 144 and can be set to any desired force within a range of available forces. Once a desired closing force is set, the nozzle element 134 can be locked into place with an optional locknut 156 (shown in dashed lines). The fluid spray nozzle 66 is illustrated in FIG. 5 with the nozzle element 134 positioned to be screwed into the extension element 132, for illustrative clarity.

The threaded end portion 152 of the nozzle element 134 extends from a main body portion 158 of the nozzle element 134, and is suitably integrally formed therewith, such as machined from stainless steel. The extension element 132 is also suitably machined from stainless steel. A fluid passageway 160 extends axially through the threaded end portion 152 of the nozzle element 134 into the main body portion 158 of the nozzle element 134 and suitably has a diameter comparable to that of the fluid passageway 138 in the extension element 132.

A nozzle tip 162 having an opening 164 for directing the flow of spraying cleaning solution (29) is disposed on an external surface of the body portion 158 of the nozzle element 134 and is in fluid communication with an opening 166 which extends into the body portion 160 of the nozzle element 134 and meets in fluid communication with an outlet end 168 of the fluid passageway 160. The nozzle tip 162, more particularly the opening 164 therein, is formed in a manner to direct cleaning solution (29) in a relative tight (rectilinear) stream which is generally radial from the main body portion 158 of the nozzle element 134. In setting up the spray gun system 60, when the clean spray extension 66 is secured in the bracket 74, it must be positioned and oriented such that the stream of cleaning solution (29) impacts the coating spray nozzle 20 in the desired manner to effect cleaning of the coating spray nozzle 20. The nozzle tip 162 is preferably made of carbide (tungsten carbide), or made of soft or stainless steel with a carbide insert (disc) brazed thereto. Brazing carbide inserts to steel work pieces is a well-known procedure.

The spray nozzle extension 66 forms a key aspect of the invention. The nozzle element 134 is mounted to the extension element 132 which contains a ball 148 and spring 150 to prevent the nozzle from dripping, dribbling or drooling.

A lacquer gun typically sprays about 300 cycles per minute. The clean spray gun 24 is readily set to operate at any interval, such as often as after every lacquer spray cycle to as infrequently as once after every fifteen lacquer spray cycles. A typical protocol would be to operate the clean spray gun 24 once for every ten operations of the lacquer spray gun 16. As mentioned above, this is all under the control of a controller 31', and cleaning solution (water) is never sprayed when the lacquer gun 16 is spraying. The ball valve (150, 148, 144) keeps the cleaning spray (29) from accumulating a film or droplets of water on the face of the cleaning spray nozzle tip (162). This is import ant so that the next time the lacquer gun(16) is cycled on, the droplet does not cause water spraying into the can(14) before the lacquer coating applied thereto has dried. It is essential to prevent water from being sprayed into the can as water can cause spots on the lacquer coating which can cause the lacquer to run, resulting in exposure (no coating) in areas of the can's surface. Since the sidewalls of beverage cans are typically only a few thousandths (0.004–0.006 inches) thick, metal exposure can enable the contents such as soft drinks or fruit juices to eat (corrode) through the aluminum of the can or contaminate the contents of the can with metal from the can itself.

As with the spray coating system 10, the cleaning spray element (24, 66) is positioned on the opposite side of the lacquer spray gun (16) with respect to the collection trough 30.

I n a typical setup of the spray gun system 60 of the present invention, the cleaning spray nozzle tip 166 would be located about 1.2–1.5 inches, and most preferably about 1.25 inches from the lacquer spray nozzle 20. This is largely determined by the bracket 74 wherein the dimension "d3" is approximately 1.437+/–0.010 inches.

The patents referenced herein are intended to be incorporated in their entireties by reference hereto.

As can now be appreciated from the above description, there has been provided in accordance with this invention an apparatus and method for operating a spray gun system, including a system for spraying a cleaning solution onto a coating gun spray nozzle to satisfy the objects and advantages set forth above. The invention not only quickly, easily and inexpensively covers the forward portions of the coating spray gun with a single spray shield to protect against overspray, but in addition, periodically cleans the forward most portion of the gun which is not so covered, namely the nozzle, with cleaning solution so that the coating system provided is impaired to the least extent possible by oversprayed coating material, substantially automatically, with a minimum of operator intervention and labor required. Additionally, the cleaning spray portion of the system incorporates a novel check valve design to reduce the possibility of cleaning solution (water) accumulating or dripping onto a freshly-coated surface of a substrate such as a can.

While the invention has been described in combination with embodiments thereof, it is evident that many alternatives, modifications, and variations will be apparent to those skilled in the art in light of the foregoing description. Accordingly, it is intended to embrace all such alternatives, modifications and variations as fall within the spirit and scope of the appended claims.

What is claimed is:

1. A spray gun system, comprising:

a coating spray gun having a coating spray gun extension and a first spray nozzle disposed at an end of the coating spray gun extension;

a cleaning solution spray nozzle having a cleaning spray extension and a second spray nozzle disposed at an end of the cleaning spray extension;

a supply valve capable of alternately permitting or prohibiting a flow of cleaning solution from a supply of pressurized cleaning solution to the cleaning solution spray nozzle; and a check valve mechanism disposed within the cleaning spray extension.

2. The spray gun system of claim 1 further comprising a fluid line connected between the supply valve and the cleaning a spray extension.

3. Th e s pray gun system of claim 2 wherein the fluid line is flexible.

4. The spray gun system of claim 2 wherein the fluid line is rigid.

5. The spray gun system of claim 2 wherein the fluid line is a stainless steel tube.

6. The spray gun system of claim 1 wherein the cleaning spray extension having the check valve mechanism disposed therein comprises:

an inlet end opening extending into an inlet end of the cleaning spray extension;

a fluid passageway extending longitudinally within the cleaning spray extension from the inlet end opening partially towards an outlet end opening of the cleaning spray extension element, to a longitudinal cylindrical chamber within the cleaning spray extension, said longitudinal cylindrical chamber having an inlet end adjacent an outlet end of the fluid passageway and an outlet end forming the outlet end opening of the cleaning spray extension, said inlet end of the longitudinal cylindrical chamber being tapered to function as a valve seat;

a ball disposed within the longitudinal cylindrical chamber; and a spring disposed within the longitudinal cylindrical chamber so as to urge the ball against the valve seat, thereby allowing fluid to flow from the fluid passageway to the longitudinal cylindrical chamber only when fluid pressure in the fluid passageway exceeds a closing force exerted by the spring on the ball.

7. The spray gun system of claim 1 further comprising a bracket having a lower portion, a middle portion and an upper portion, wherein:

the lower portion has a first bore sized to fit around an exterior surface of the coating spray gun extension; and the upper portion has a first bore sized to fit around an exterior surface of the cleaning spray extension.

8. The spray gun system of claim 7 further comprising:

a first set screw extending into the first bore for securely positioning and orienting the coating spray gun extension within the bracket; and a second set screw extending into the second bore for securely positioning and orienting the cleaning spray extension within the bracket.

9. The spray gun system of claim 8 wherein the bracket establishes a desired spacing between the coating spray gun extension and the cleaning spray extension.

10. The spray gun system of claim 1 further comprising:

a spray shield having a tubular portion sized to fit snugly over the spray gun extension and a radial flange portion sized to extend substantially to an external surface of the cleaning spray extension.

11. The spray gun system of claim 1 further comprising:

a spray shield having a tubular portion sized to fit snugly over the spray gun extension and a radial flange portion sized to extend at least partially around an external surface of the cleaning spray extension.

12. In a spray gun system having a coating spray gun component and a cleaning spray component positioned in spaced relationship to the coating spray gun component, the improvement comprising:

a single spray shield having a tubular portion adapted to fit snugly over the coating spray gun component and a radial flange portion for protecting both the spray gun component and the cleaning spray component from over-sprayed coating material.

13. The spray gun system of claim 12 wherein the spray shield is made of a material selected from the group comprising polyethylene and polypropylene.

14. The spray gun system of claim 12 wherein the spray shield has a generally uniform wall thickness of 0.020 to 0.040 inches.

15. The spray gun system of claim 12 wherein the radial flange portion of the spray shield comprises a cutout to receive the cleaning spray component.

16. In a spray gun system having a coating spray gun component and a cleaning spray component positioned in spaced relationship to the coating spray gun component, the improvement comprising:

a single spray shield having a tubular portion adapted to fit snugly over the coating spray gun component and a radial flange portion extending from an end of the tubular portion at least partially around an external surface of the cleaning spray component.

17. The spray gun system of claim 16 wherein the spray shield is made of a material selected from the group comprising polyethylene and polypropylene.

18. The spray gun system of claim 16 wherein the spray shield has a generally uniform wall thickness of 0.020 to 0.040 inches.

19. The spray gun system of claim 16 wherein the radial flange portion of the spray shield comprises a cutout to receive the cleaning spray component.

20. A single spray shield adapted to protect a coating spray gun component and a cleaning spray component positioned in spaced relationship to the coating gun component, the spray shield comprising:

a tubular portion adapted to fit snugly over the coating spray gun component and a radial flange portion extending from an end of the tubular portion at least partially around an external surface of the cleaning spray component, the radial flange portion of the spray shield having a cutout to receive the cleaning spray component.

* * * * *